US007331887B1

(12) United States Patent
Dunn

(10) Patent No.: US 7,331,887 B1
(45) Date of Patent: Feb. 19, 2008

(54) GAME FINDER

(76) Inventor: Alan Lee Dunn, 510 Main St., Genoa, OH (US) 43430

( * ) Notice: Subject to any disclaimer, the term of this patent is extended or adjusted under 35 U.S.C. 154(b) by 313 days.

(21) Appl. No.: 11/090,454

(22) Filed: Mar. 26, 2005

(51) Int. Cl.
*F42B 6/04* (2006.01)

(52) U.S. Cl. ..... 473/578; 455/98

(58) Field of Classification Search ..... 473/578; 342/386; 455/98
See application file for complete search history.

(56) References Cited

U.S. PATENT DOCUMENTS 3,790,948 A * 2/1974 Ratkovich ..... 342/386
4,976,442 A * 12/1990 Treadway ..... 473/570
5,024,447 A * 6/1991 Jude ..... 473/570
5,134,552 A * 7/1992 Call et al. ..... 362/203
5,157,405 A * 10/1992 Wycoff et al. ..... 342/386
5,188,373 A * 2/1993 Ferguson et al. ..... 473/583
5,251,907 A * 10/1993 Ady ..... 473/571
5,446,467 A * 8/1995 Willett ..... 342/386

* cited by examiner

*Primary Examiner*—John A. Ricci

(57) ABSTRACT

A game finder which facilitates finding of an arrow after it is shot is disclosed. The game finder includes an arrow and at least one transmitting module provided on the arrow for emitting a recovery signal when the arrow strikes game or a target.

10 Claims, 5 Drawing Sheets

GAME FINDER

FIELD OF THE INVENTION

The present invention relates to arrow hunting accessories. More particularly, the present invention relates to a game finder which includes an arrow fitted with at least one transmitting module that transmits light and/or activates a receiver to indicate the location of the arrow to a shooter after it is shot.

BACKGROUND OF THE INVENTION

Bow hunting is a popular sport in the United States and around the world. In bow hunting, a hunter uses a stringed bow to propel an arrow at game such as deer, antelope or bear in an attempt to strike and kill the game with the arrow. While it can be an, effective technique used to kill game, bow hunting requires skill to strike the game in a vital organ to hasten the death and capture of the fallen game.

One of the limitations of bow hunting is that an arrow is frequently shot into the game in such a manner that the game is not immediately killed or immobilized. The game may then run off with the arrow stuck into its flesh. In such cases, an attempt is frequently made to locate the game by following a blood trail on the ground or by other means. In many game-hunting environments, such as those which are heavily wooded or semi-dark, this can render it difficult or impossible to locate the game. Therefore, a game finder is needed to facilitate locating game after the game is struck with an arrow.

SUMMARY OF THE INVENTION

The present invention is generally directed to a game finder which facilitates finding of an arrow after it is shot into game or a target. The game finder includes an arrow and at least one transmitting module provided on the arrow for emitting a recovery signal when the arrow strikes game or a target. The game finder may further include a receiver unit which is activated by the transmitting module or modules to indicate the location of the arrow to the shooter.

BRIEF DESCRIPTION OF THE DRAWINGS

The invention will now be described, by way of example, with reference to the accompanying drawings, in which.

DETAILED DESCRIPTION OF THE INVENTION

Figure 1:
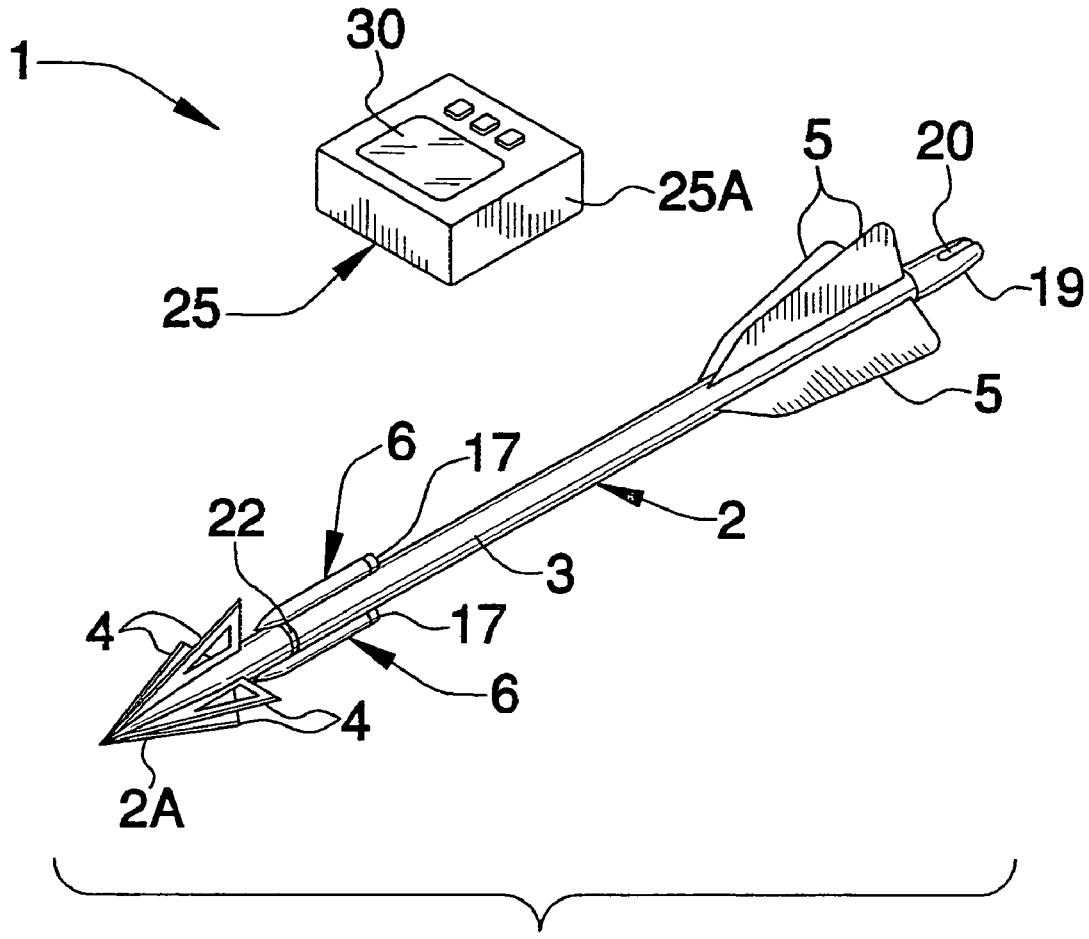
FIG. 1 is a perspective view of an arrow and a receiver unit of an illustrative embodiment of the game finder according to the present invention.

An illustrative embodiment of the game finder according to the present invention is generally indicated by reference numeral 1 in FIG. 1. The game finder 1 includes an arrow 2 which can be shot using a standard stringed bow (not illustrated). The game finder 1 may further include a receiver unit 25 which can be used to track, locate or find the arrow 2 in the event that the arrow 2 is misplaced or lost after being shot from the bow, as will be hereinafter described.

Figure 4:
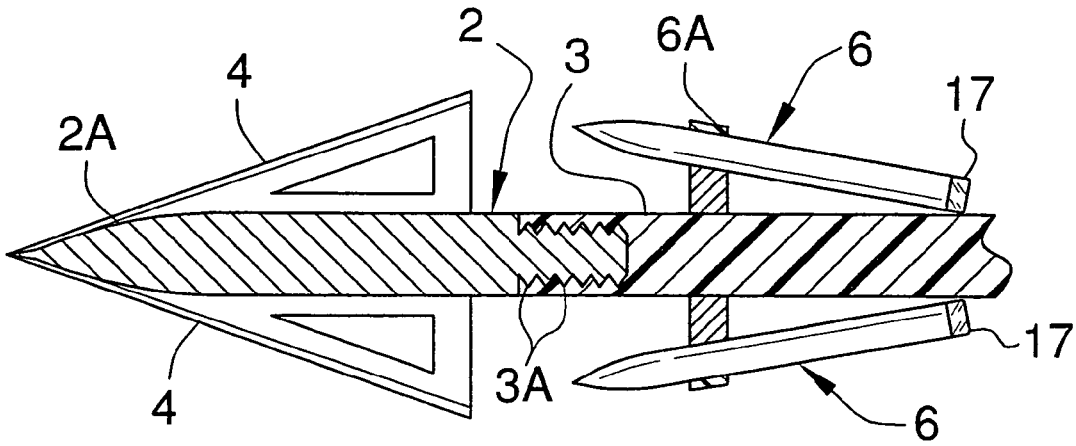
FIG. 4 is a longitudinal cross-section of a portion of the arrow, illustrating threaded attachment of an arrow tip onto the main shaft of the arrow.

As illustrated in FIG. 1, the arrow 2 includes an elongated shaft 3, the rear end portion of which is fitted with multiple flights 5 that are spaced-apart about the circumference of the shaft 3, typically in conventional fashion. A neck 19, having a string notch 20, is provided on the rear end of the shaft 3. As illustrated in FIG. 4, an arrow tip 2*a* may be attached to the front end of the shaft 3. The arrow tip 2*a* is provided with multiple blades 4 and typically engages the shaft 3 through threads 3*a*. A nylon ring 22 may be interposed between the arrow tip 2*a* and the shaft 3. Alternatively, the arrow tip 2*a* may be one piece with the shaft 3.

Figure 2:
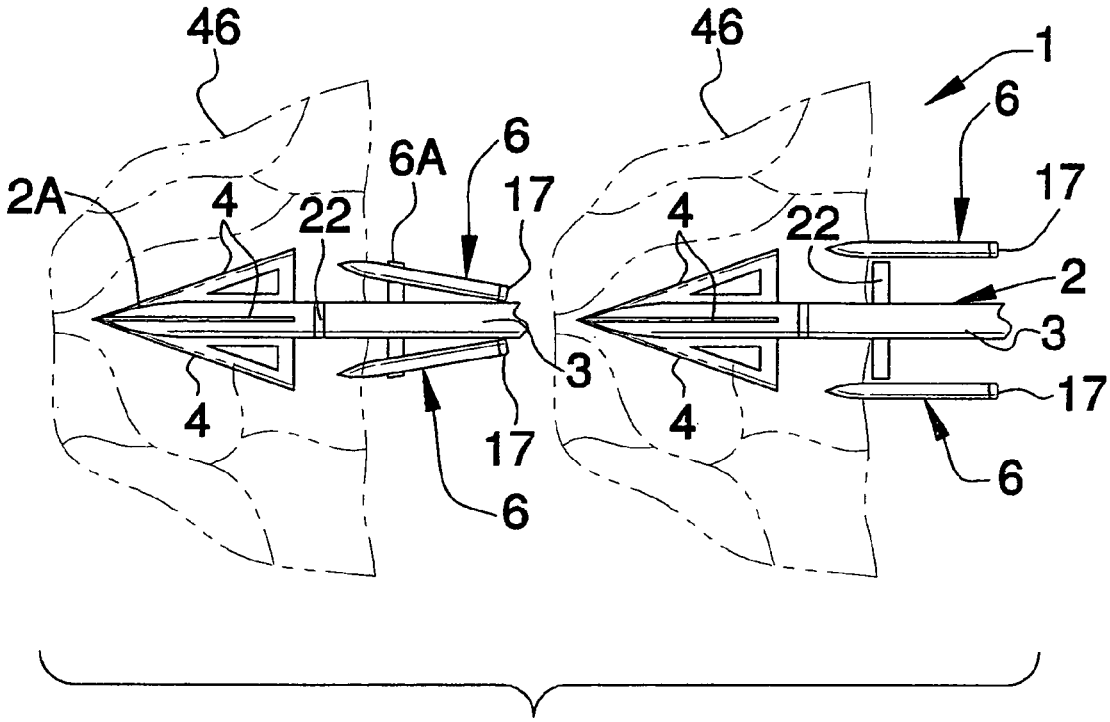
FIG. 2 is a top view, partially in section, of an arrow of the game finder, illustrating embedding of the arrow into game flesh and simultaneous breaking away of the transmitting modules from the arrow.
Figure 3:
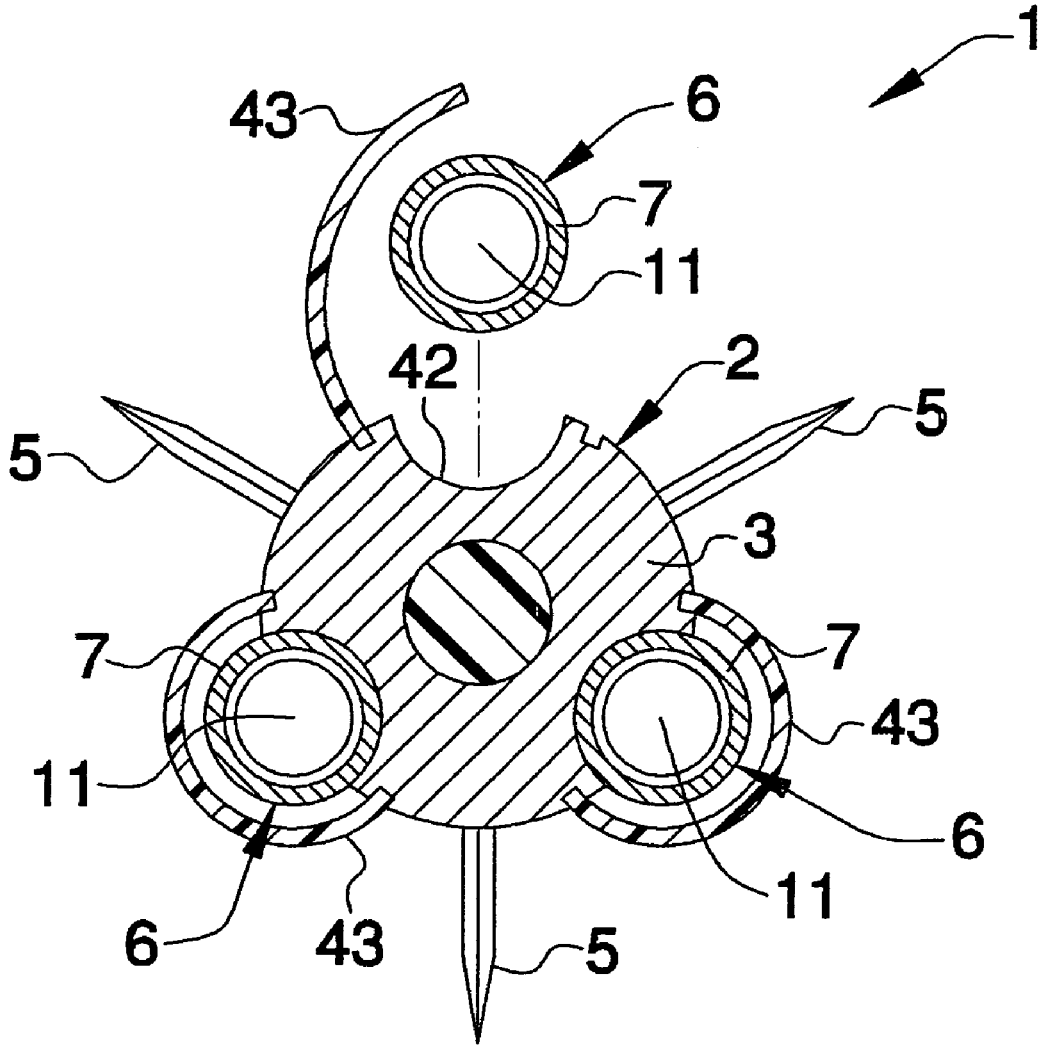
FIG. 3 is a cross-sectional view of an arrow of the game finder, illustrating an exemplary break away band technique for mounting the transmitting modules on the arrow.

As illustrated in FIGS. 1-4, multiple transmitting modules 6 are removably attached to the shaft 3 of the arrow 2, typically just behind the arrow tip 2*a*. Each of the transmitting modules 6 may be removably attached to the shaft 3 using any of a variety of techniques. For example, as illustrated in FIG. 1, the transmitting modules 6 may be removably attached to the ring 22 which is interposed between the arrow tip 2*a* and the shaft 3, using a loose-binding glue, for example, or other techniques which are known by those skilled in the art. Alternatively, as shown in FIGS. 2 and 4, a module support 6*a* may be mounted on the shaft 3 and the modules 6 friction-fitted or snapped into respective notches (not shown) provided in the module support 6*a*. Still further in the alternative, as shown in FIG. 3, multiple module depressions 42 may be provided in the outer surface of the shaft 3, in which case the transmitting modules 6 are seated in the respective module depressions 42. A module cover 43 removably engages the shaft 3 and covers the transmitting modules 6 to enclose the transmitting modules 6 in the respective module depressions 42.

Figure 5:
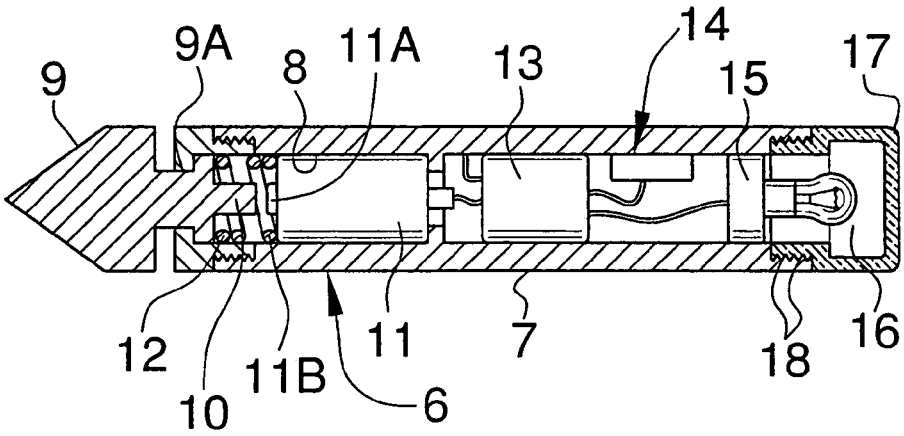
FIG. 5 is a longitudinal sectional view of a transmitting module of the game finder.

As shown in FIG. 5, each transmitting module 6 includes an elongated, typically cylindrical housing 7 having a housing interior 8. A module tip 9 slidably extends through a tip opening 9*a* provided in the front end of the module housing 7 and includes a tip base 10 that extends inside the housing interior 8. A battery 11 is contained in the housing interior 8 and has a positive pole 11*a* which faces the tip base 10. A spring 12 contained in the housing interior 8 contacts the negative pole 11*b* of the battery 11 and normally biases the module tip 9 in an extended position from the module housing 7 and maintains the tip base 10 in spaced-apart relationship to the positive pole 11*a* of the battery 11, thus breaking electrical contact between the positive pole 11*a* and negative pole 11*b* of the battery 11. On the other hand, when the module tip 9 is pushed into the tip opening 9*a*, the tip base 10 contacts the positive pole 11*a*, thereby establishing electrical contact between the positive pole 11*a* and negative pole 11*b* of the battery 11 and energizing the battery 11 through the tip base 10 and spring 12.

A microprocessor 13 contained in the housing interior 8 is electrically connected to the battery 11. A transmitter 14 in the housing interior 8 is electrically connected to the microprocessor 13. A light socket 15 is fitted in the rear end of the module housing 7 and is electrically connected to the transmitter 14, and a light bulb or LED 16 is threaded in the light socket 15. A transparent or translucent cap 17 is typically threaded on the rear end of the module housing 7 via cap threads 18 and encloses the light bulb or LED 16.

The microprocessor 13 can be selected to activate the transmitter 14, energize and illuminate the light bulb or LED 16 or both activate the transmitter 14 and energize or illuminate the light bulb or LED 16 upon receiving electric current from the battery 11, as will be hereinafter described.

Figure 6:
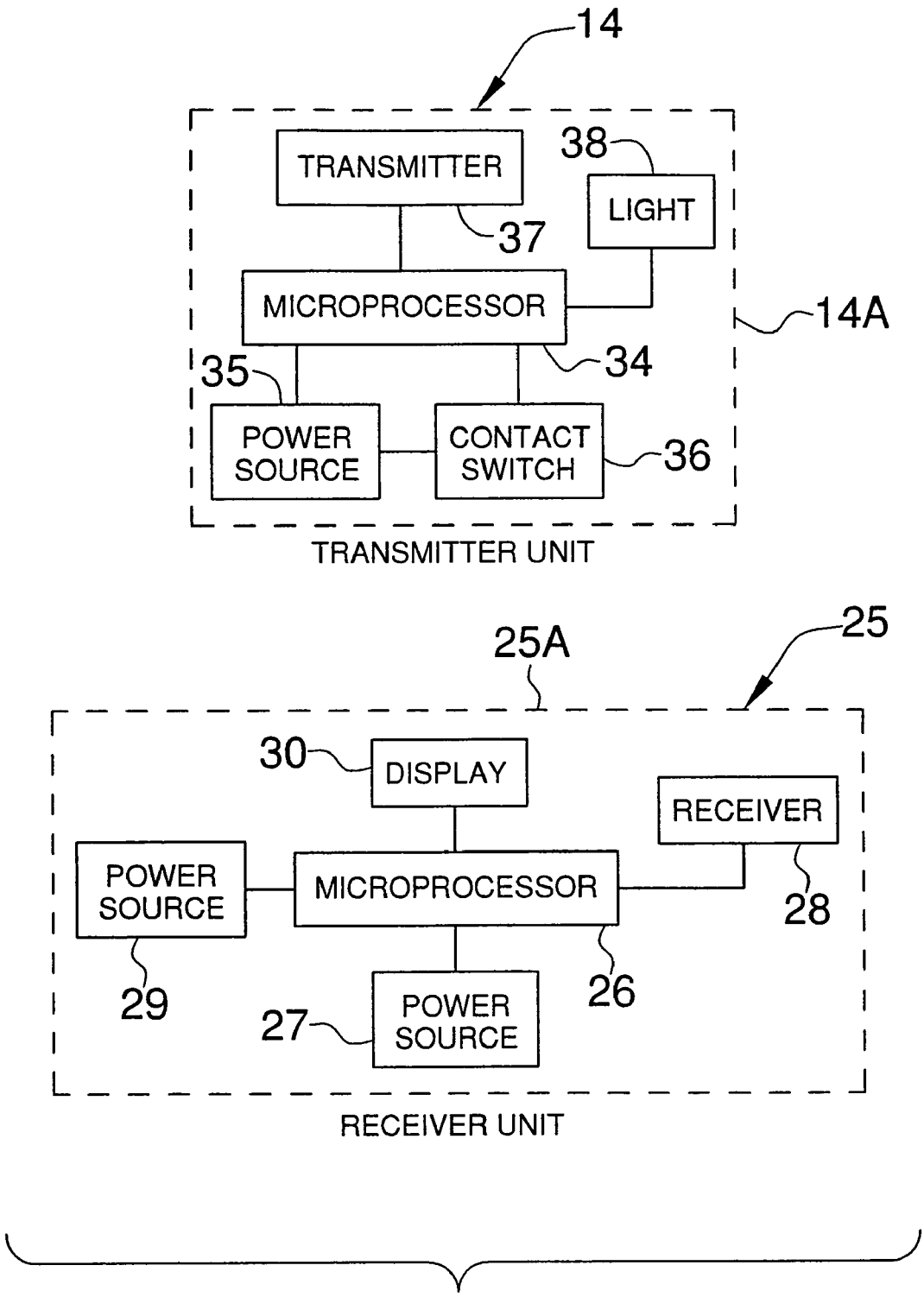
FIG. 6 are schematic diagrams of a transmitter and a receiver unit, respectively, of the game finder.

As illustrated in FIG. 6, the transmitter unit 14 typically includes a transmitter unit housing 14*a* which contains the transmitter unit components. These may include, for example, a microprocessor 34 which is connected to the microprocessor 13 (FIG. 5), as well as a power source 35 connected to the microprocessor 34; a contact switch 36 connected to the microprocessor 34 and power source 35 for energizing the microprocessor 34; and a transmitter 37 and a light 38 individually connected to the microprocessor 34. The microprocessor 34 includes the capability of activating the transmitter 37 and causing the transmitter 37 to emit electromagnetic signals which activate the receiver unit 25 upon activation by the microprocessor 13, as will be hereinafter described.

As further shown in FIG. 6, the receiver unit 25 typically includes a receiver unit housing 25*a* which contains the receiver unit components. These may include, for example, a microprocessor 26; a power source 27 and a power source 29 individually connected to the microprocessor 26; a receiver 28 connected to the microprocessor 26; and a display 30 connected to the microprocessor 26. The receiver 28 is capable of sensing electromagnetic signals emitted by the transmitter 37 of the transmitter unit 14. The display 30 may include an electronic map, for example, or a numerical digital display which is capable of indicating the relative location or distance of the receiver unit 25 with respect to the transmitting module 6 responsive to the strength of electromagnetic signals received by the receiver 28 from the transmitter 37 of the transmitter unit 14. The microprocessor 26 includes the capability of converting the relative strength of the electromagnetic signals, as indicated by electrical signals transmitted from the receiver 28, into location or distance and indicating this information as the relative location or distance of the receiver unit 25 with respect to the transmitting module 6 on the display 30.

Referring next to FIGS. 2, 3, 5 and 6, in typical application of the game finder 1, the arrow 2 is shot from a stringed bow (not shown), which may be conventional, typically in an attempt to shoot game such as deer or antelope, for example. Next, the shooter (not illustrated) holds the receiver unit 25 in his or hand or wears the receiver unit 25 on his or her clothing, for example. As shown in FIG. 2, as the arrow tip 2*a* pierces and becomes embedded in the flesh 46 of the game, the transmitting modules 6 contact and become embedded in the flesh 46. Simultaneously, the transmitting modules 6 break away from the module support 6*a* (FIG. 2) or the ring 22 (FIG. 1), or the module covers 43 break away from the arrow 2 and release the transmitting modules 6, as shown in FIG. 3. As the module tip 9 of each transmitting module 6 strikes and pierces the game flesh 46, the module tip 9 is pushed through the tip opening 9*a* (FIG. 5) and the tip base 10 contacts the positive pole 11*a* of the battery 11, thus energizing the battery 11. Therefore, the battery 11 transmits an electric current to the microprocessor 13, which generates a recovery signal by activating the transmitter unit 14, the light bulb or LED 16, or both depending on the selection previously chosen on the transmitter unit 14.

The transmitter 37 of the transmitter unit 14 activates the receiver 28 of the receiver unit 25 by emitting recovery signals in the form of electromagnetic signals such as radio waves, for example, as heretofore noted. The strength or magnitude of the electromagnetic signals is indirectly proportional to the distance between the receiver unit 25 and the transmitting modules 6. Therefore, the microprocessor 26 of the receiver unit 25 determines the location or distance of the receiver unit 25 with respect to the transmitting modules 6 depending on the strength or magnitude of the electromagnetic signals picked up by the receiver 28 from the transmitter 37 of the transmitter unit 14. The microprocessor 26 indicates this information in the form of location (in the case of an electronic map) or distance (in the form of digital numerals) on the display 30. Therefore, the shooter can view this information on the display 30 and ascertain in which direction he or she must proceed in order to reach the arrow 2. The closer the shooter gets to the arrow 2, the stronger the electromagnetic signals transmitted by the transmitting modules 6 to the receiver unit 25, and therefore, the closer the location or distance indicated on the display 30 of the receiver unit 25. Finally, the shooter arrives within sighting distance of the arrow 2 and is capable of retrieving the arrow 2 and/or the game in which the arrow is stuck. As the shooter searches for the arrow 2, the light bulb or LED 16 is illuminated, thus enhancing visual sighting of the arrow 2 by the shooter, particularly in a dark environment.

While the preferred embodiments of the invention have been described above, it will be recognized and understood that various modifications can be made in the invention and the appended claims are intended to cover all such modifications which may fall within the spirit and scope of the invention.

What is claimed is:

1. A game finder comprising:

an arrow;

at least one transmitting module carried by said arrow for emitting a recovery signal at least one module depression provided in said arrow and wherein said at least one transmitting module is provided in said at least one module depression, respectively; and at least one module cover removably carried by said arrow for covering said at least one transmitting module, respectively.

2. The game finder of claim 1 wherein said at least one transmitting module comprises a module housing, a module tip slidably carried by said module housing, a battery provided in said module housing for removable electrical contact with said module tip, and a lighting device electrically connected to said battery for emitting the recovery signal.

3. The game finder of claim 2 further comprising a spring provided in said module housing for normally biasing said module tip away from said battery.

4. The game finder of claim 1 further comprising at least one module support carried by said arrow and wherein said at least one module is removably carried by said at least one module support, respectively.

5. The game finder of claim 1 further comprising a receiver unit for activation by said at least one transmitting module.

6. The game finder of claim 1 wherein said at least one transmitting module comprises a plurality of transmitting modules.

7. A game finder comprising:

an arrow including an elongated shaft having front and rear ends and an arrow tip provided on said front end of said shaft;

a plurality of transmitting modules carried by said shaft behind said arrow tip and in spaced-apart relationship to each other around said shaft for emitting a recovery signal; and a receiver unit for activation by said at least one transmitting module.

8. The game finder of claim 7 wherein each of said plurality of transmitting modules comprises a module housing, a module tip slidably carried by said module housing, a battery provided in said module housing for removable electrical contact with said module tip, a microprocessor provided in said module housing and electrically connected to said battery, and a transmitter unit and a lighting device electrically connected to said microprocessor for emitting the recovery signal.

9. The game finder of claim 8 wherein said transmitter unit comprises a power source, a second microprocessor electrically connected to said power source and said microprocessor, a contact switch electrically connected to said power source and said second microprocessor, and a light and a transmitter electrically connected to said second microprocessor.

10. The game finder of claim 9 wherein said receiver unit comprises a second power source, a third microprocessor electrically connected to said second power source, and a receiver and a display electrically connected to said third microprocessor.

* * * * *

UNITED STATES PATENT AND TRADEMARK OFFICE

CERTIFICATE OF CORRECTION

PATENT NO. : 7,331,887 B1
APPLICATION NO. : 11/090454
DATED : February 19, 2008
INVENTOR(S) : Allan Lee Dunn It is certified that error appears in the above-identified patent and that said Letters Patent is hereby corrected as shown below:

On the Title Page, (76) Item, the Inventors name is spelled incorrectly: Alan Lee Dunn.

The correct legal spelling: Allan Lee Dunn.

Signed and Sealed this
Twenty-ninth Day of March, 2011

David J. Kappos

David J. Kappos
*Director of the United States Patent and Trademark Office*